United States Patent [19]

Wood

[11] 4,180,191

[45] Dec. 25, 1979

[54] BOTTLE CARRIER

[75] Inventor: Prentice J. Wood, Hapeville, Ga.

[73] Assignee: The Mead Corporation, Dayton, Ohio

[21] Appl. No.: 926,858

[22] Filed: Jul. 26, 1978

[51] Int. Cl.[2] ..... B65D 71/00

[52] U.S. Cl. ..... 224/45 BA; 294/87.2; 206/147

[58] Field of Search ..... 224/45 BA, 45 AA, 45 AB; 294/87.2, 87; 206/150, 147, 158, 162

[56] References Cited

U.S. PATENT DOCUMENTS

| | | | |
|---|---|---|---|
| 3,752,305 | 8/1973 | Heyne | 294/87.2 |
| 3,860,281 | 1/1975 | Wood | 294/87.2 |
| 3,946,862 | 3/1976 | Klygis et al. | 294/87.2 |

FOREIGN PATENT DOCUMENTS

| | | | |
|---|---|---|---|
| 1423952 | 11/1965 | France | 294/87.2 |

*Primary Examiner*—Robert J. Spar
*Assistant Examiner*—Kenneth Noland
*Attorney, Agent, or Firm*—Walter M. Rodgers; Walter A. Rodgers

[57] ABSTRACT

A carrier of the top gripping type for use in conjunction with bottles having neck flanges (F) comprises an elongated tubular structure having a bottom wall (1) in which a plurality of bottle neck receiving apertures (3,4,5) are formed and to the side edges of which a pair of inwardly tapered side walls are foldably joined, each side wall including inner and outer face contacting complementary panels (8,10,14,27), a plurality of bottle flange receiving apertures (11-13,15-17) formed in each side wall, a handle panel having finger gripping apertures (20,21,24,25) and formed of a pair of panels (18,22) which are respectively foldably joined along the bottom edges thereof to the top edges of the outer complementary panel (14,27) of each side wall respectively together with a plurality of single ply pull tabs (31,32,33) struck respectively from the neck receiving apertures in the bottom wall and extending downwardly in complanar relationship with the inner complementary panel (8) of one side wall together with a pair of severance lines (34-39) formed in the one inner complementary panel and respectively disposed in general alignment with the side edges of the pull tabs, and a plurality of pairs of complementary severance lines (40-45) formed in the outer complementary panel which is associated with the inner complementary panel of the one side wall.

4 Claims, 8 Drawing Figures

BOTTLE CARRIER

TECHNICAL FIELD

This invention relates to bottle carriers and more particularly to bottle carriers of the elongated tubular type and which are especially adapted to engage outwardly projecting flanges formed in the upper neck portions of large bottles.

BACKGROUND ART

Bottle carriers of the elongated, tubular, topgripping type for use in conjunction with compression caps or with screw on caps are particularly well adapted for engaging the lower edges of such caps. An example of such a top gripping carrier is that disclosed and claimed in U.S. Pat. No. 3,860,281, owned by the assignee of this invention.

DISCLOSURE OF INVENTION

According to this invention in one form, a carrier of the top gripping type is provided which is especially adapted for use in conjunction with large bottles having neck flanges and is constructed so as not only to provide a secure package from which inadvertent dislodgment of the bottles is unlikely but which is also especially adapted for easy removal of one or more packaged bottles at the point of use and includes a bottom wall having apertures therein for receiving the necks of the packaged bottles, two inwardly tapered side walls each including inner and outer face contacting complementary side wall panels and being foldably joined along their lower edges to the side edges of the bottom wall and having bottle flange receiving apertures formed therein and to the upper edges of the outer complementary side wall panel of which a pair of handle panels are respectively foldably joined and a tear strip struck from the bottle neck receiving apertures formed in the bottom wall and disposed in integral coplanar relationship with the inner complementary panel of one side wall together with severance lines disposed in general alignment with the side edges of each pull tab and formed in both the inner and outer complementary panel of said one side wall whereby ready removal of each bottle is made possible without impairing the strength and integrity of the carrier.

BRIEF DESCRIPTION OF THE DRAWINGS

In the drawings

FIGS. 6 and 7 are end views of the carrier showing the handle in straight up and turned down positions respectively and in which

BEST MODE FOR CARRYING OUT THE INVENTION

Figure 6:
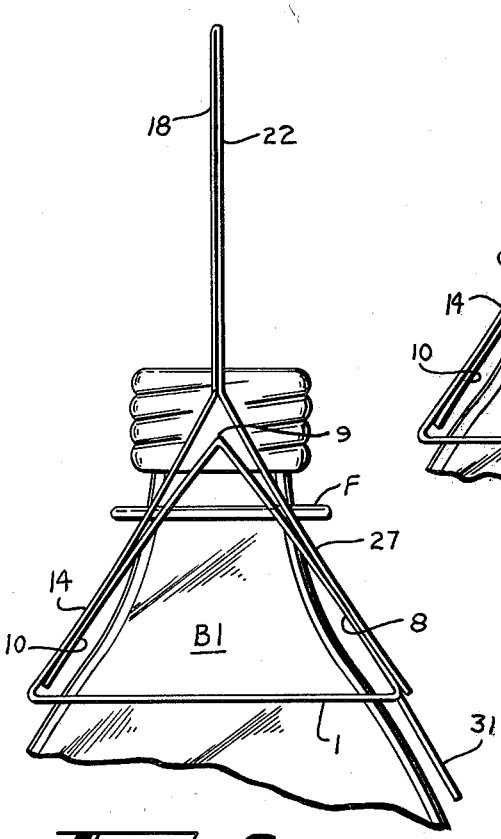
Figure 7:
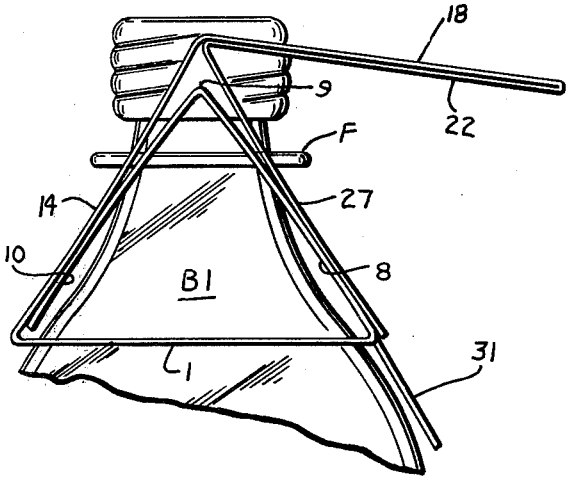

In the drawings the numeral 1 designates the bottom wall in which a longitudinal medial fold line 2 is formed and in which a plurality of bottle neck receiving apertures 3, 4 and 5 are formed. The side edges of the bottom wall 1 are defined by fold lines 6 and 7.

Figure 2:
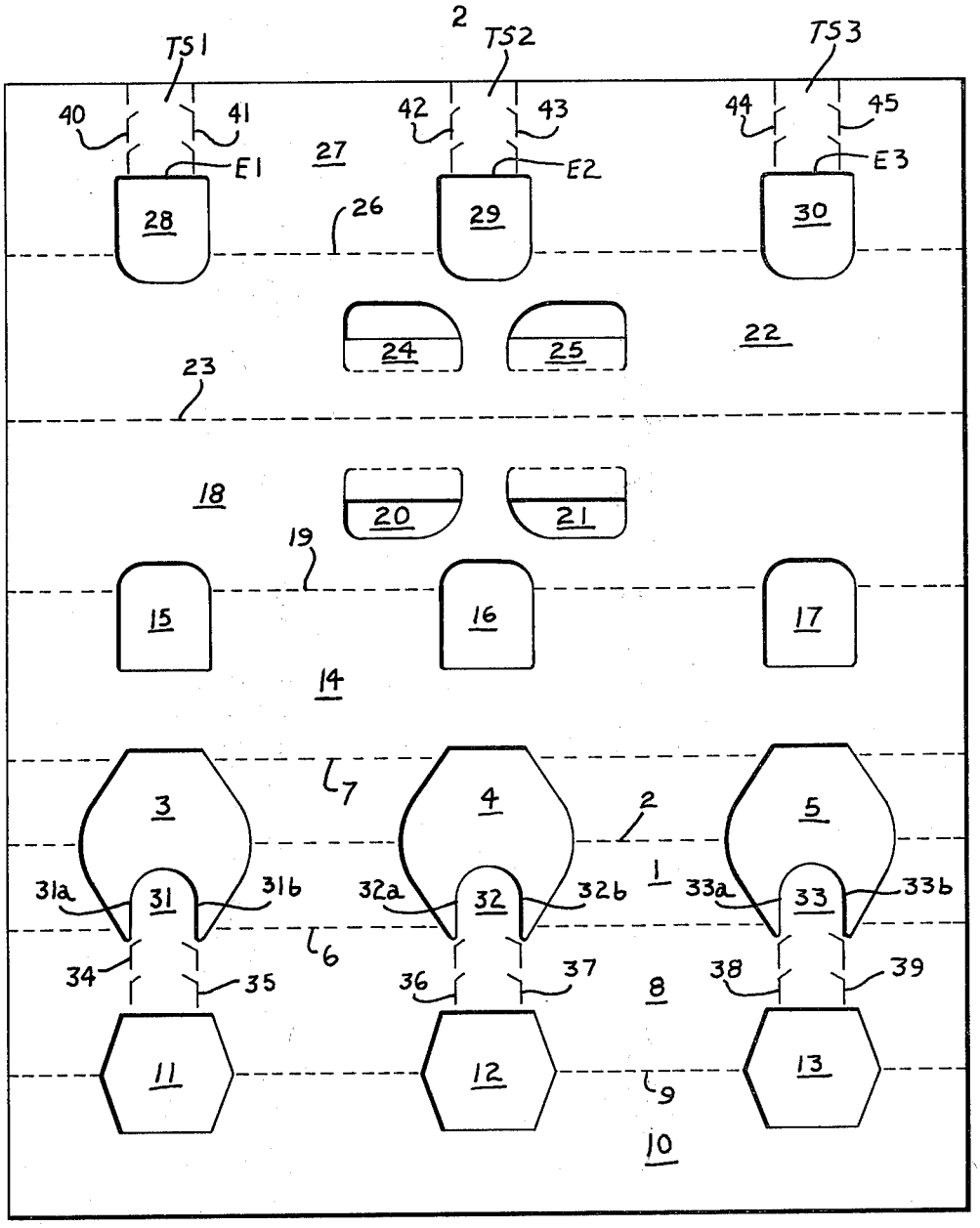
FIG. 2 is a plan view of a blank from which the carrier of FIG. 1 is formed.
Figure 3:
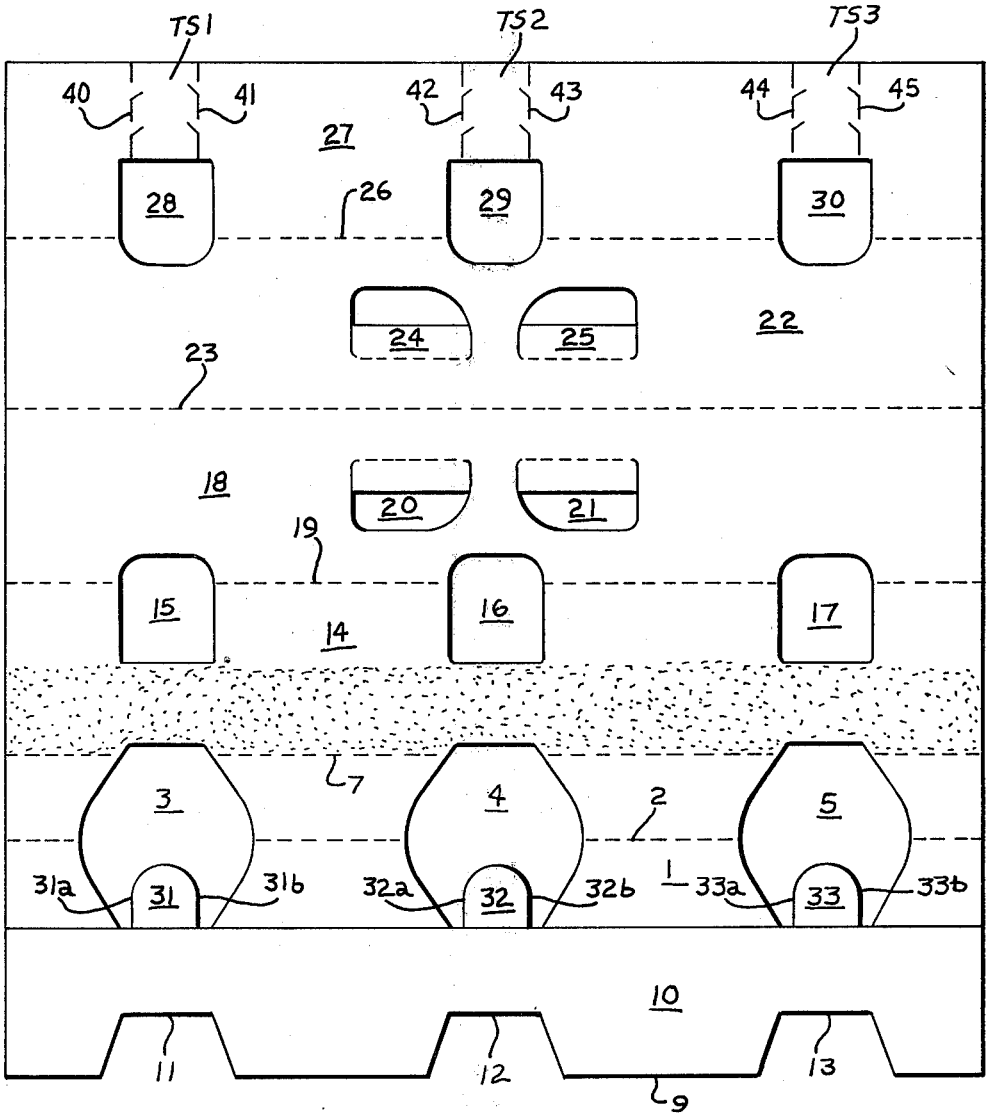
FIGS. 3 and 4 depict intermediate stages through which the blank of FIG. 2 is manipulated.

An inner complementary side wall panel 8 is foldably joined to one side edge of bottom wall 1 along fold line 6 and the upper edge of inner complementary side wall panel 8 is defined by interrupted fold line 9 which separates inner complementary side wall panel 8 from inner complementary side wall panel 10. A plurality of bottle flange receiving apertures 11, 12 and 13 are formed in the upper portions of inner complementary side wall panels 8 and 10 as is best seen in FIG. 2. Outer complementary side wall panel 14 is foldably joined to bottom wall 1 along fold line 7 and includes portions of a plurality of bottle flange receiving apertures 15, 16, and 17. A handle panel 18 is foldably joined to outer complementary side wall panel 14 along interrupted fold line 19 and is provided with a pair of finger gripping apertures 20 and 21. A second handle panel 22 is foldably joined along top medial fold line 23 to handle panel 18 and includes a pair of finger gripping apertures 24 and 25.

Foldably joined to handle panel 22 along fold line 26 is an outer complementary side wall panel 27 in which parts of bottle flange receiving apertures 28, 29 and 30 are formed. As is apparent particularly from FIG. 2, parts of bottle flange receiving apertures 28, 29 and 30 may be formed in handle panel 22.

Figure 1:
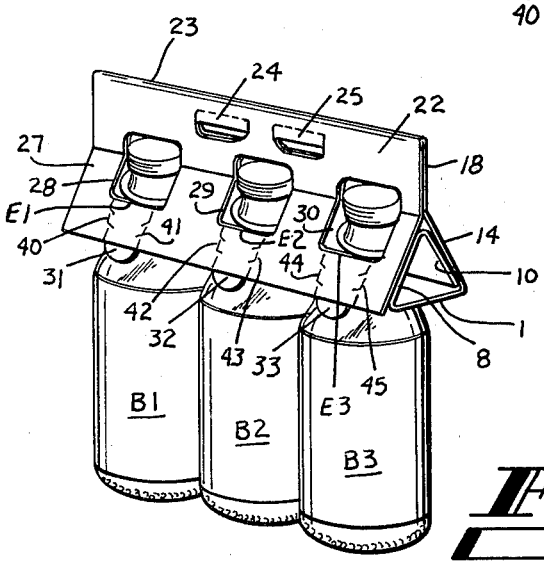
FIG. 1 is a perspective view of a carrier formed according to the invention and showing the carrier applied to three bottles.

For rendering removal of the bottles from the carrier feasible and practical, a plurality of pull tabs 31, 32 and 33 are struck from bottle neck receiving apertures 3, 4, and 5 respectively and constitute downwardly extending coplanar projections of inner complementary side wall panel 8 as is apparent from FIG. 1.

Formed as continuations of the side edges such as **31*a* and 31*b* of pull tab 31 are a pair of severance lines 34 and 35. Similarly severance lines 36 and 37 are formed in panel 8 and are in general alignment with the sides 32*a* and 32*b* of pull tab 32 while severance lines 38 and 39 are formed as general continuations of the side edges 33*a* and 33*b* of pull tab 33**.

Disposed in coincidence with the severance lines 34 and 35 are the severance lines 40 and 41 formed in outer complementary side wall panel 27 while severance lines 42 and 43 also formed in outer complementary side wall panel 27 are in coincidence with severance lines 36 and 37 formed in inner complementary side wall panel 8. Similarly severance lines 44 and 45 formed in outer complementary side wall panel 27 are disposed in coincidence with severance lines 38 and 39 respectively formed in inner complementary side wall panel 8.

In order to form the carrier shown for example in FIG. 1 from the blank shown in FIG. 2, inner complementary side wall panel 10 is folded upwardly and over into flat face contacting relation with inner complementary side wall panel 8 and an application of glue is made to outer complementary panel 14 as is indicated by stippling in FIG. 2. Thereafter inner complementary side wall panels 8 and 10 are elevated and bottom wall 1 is folded along its longitudinal medial fold line 2 in order to cause the inner complementary side wall panel 10 to adhere in flat face contacting relation to outer complementary panel 14. These panels are secured together over at least substantial portions of their areas.

Figure 4:
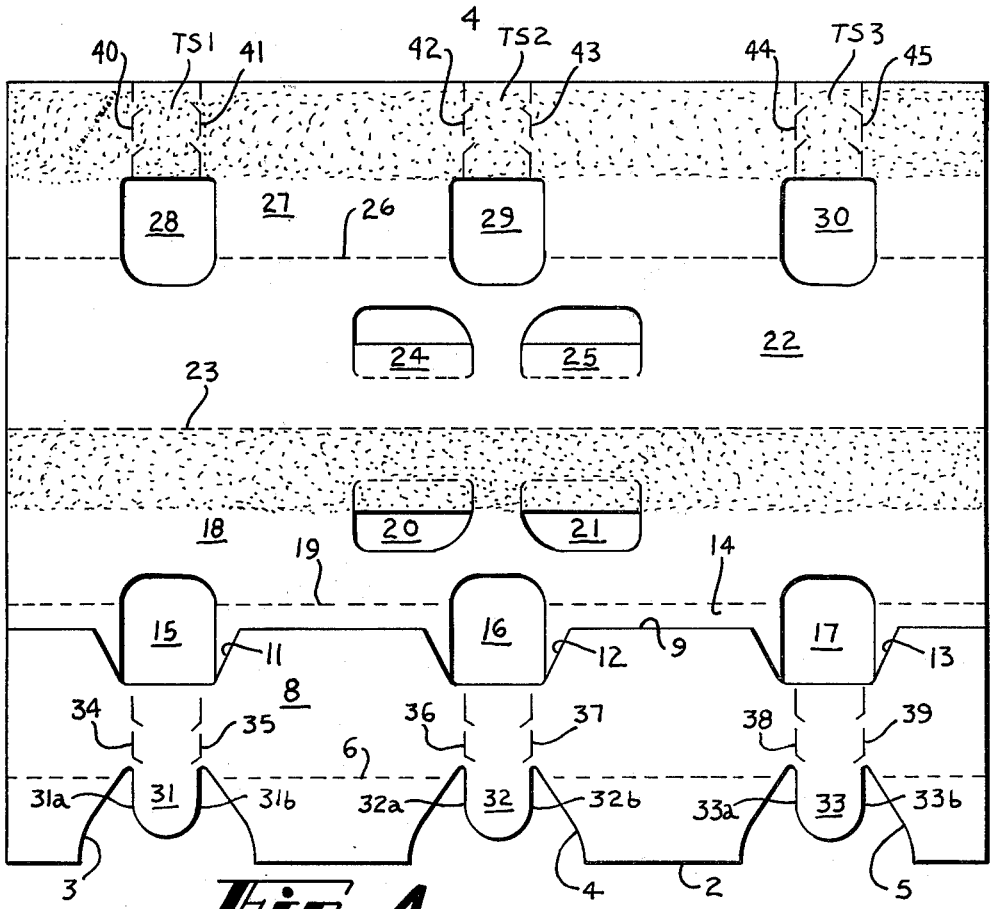
Figure 5:
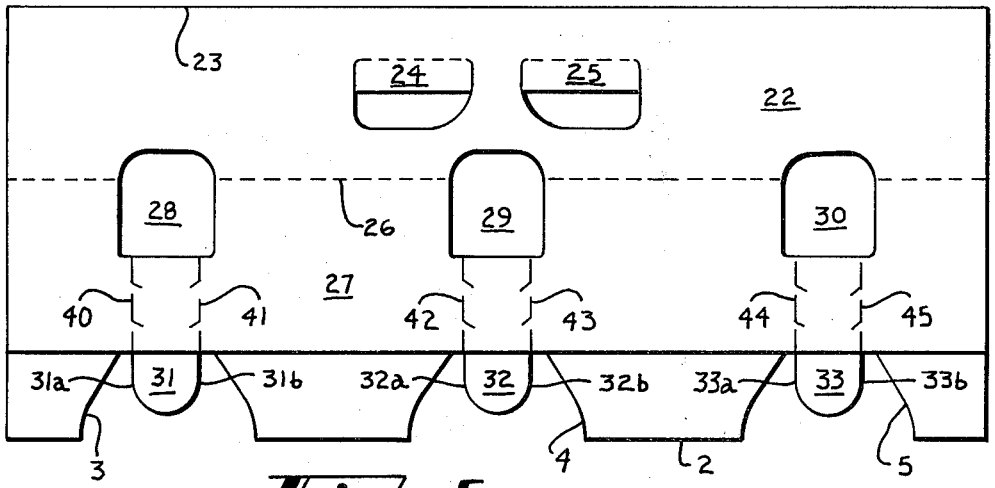
FIG. 5 shows the completed carrier in collapsed condition.

The carrier then appears as shown in FIG. 4. Thereafter an application of glue is made to handle panel 18 and to outer complementary side wall panel 27 as shown by stippling in FIG. 4 following which outer complementary side wall panel 27 and handle panel 22 are elevated and folded along fold line 23 to cause the outer complementary side wall panel 27 to adhere to inner complementary side wall panel 8 and to cause handle panel 22 to adhere to handle panel 18. The carrier is then complete and in collapsed form as shown in FIG. 5. In order to set the carrier up, it is necessary simply to fold the portions of bottom panel 1 into coplanar relationship along fold line 2 and the carrier then appears as shown for example in FIG. 1. The bottles B1, B2 and B3 are loaded into the carrier by simply lowering the set-up carrier downwardly over the bottle caps and necks so as to cause the flanges F of the bottles to move into the bottle flange receiving apertures 15, 16, 17, 28, 29 and 30 so that the flanges rest on the lower edges such as E1, E2 and E3 of flange receiving apertures 28, 29 and 30 and on the corresponding edges of flange receiving apertures 15, 16 and 17 while the necks of the bottles are disposed within neck receiving apertures 3, 4 and 5 formed in bottom wall 1.

With the carrier assembled as shown in FIG. 1, for example, the bottle flanges are securely held in place due in part to the double thickness of the inwardly tapered side walls and to the fact that the board itself is preferably made of heavy duty paperboard.

Figure 8:
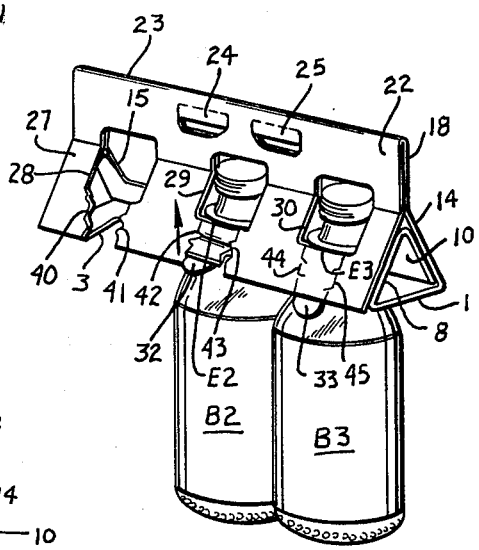
FIG. 8 is a perspective view of the carrier similar in some respects to FIG. 1 and which depicts pull tabs and their associated tear strips in partially and in completely torn out condition.

For the purpose of dislodging the bottles from the carrier, it is simply necessary manually to grasp the pull tabs such as 31, 32 and 33 and to exert an outward upward pull thereon which effectively removes the tear strips TS1, TS2, and TS3. For example tear strip TS1 is of double thickness and is defined by severance lines 34 and 35 and the registering severance lines 40 and 41. Once the tear strip TS1 is removed, bottle B1 may obviously be removed from the carrier as indicated in FIG. 8. In like fashion tear strip TS2 is defined by severance lines 36 and 37 and their registering severance lines 42 and 43 respectively while tear strip TS3 is defined by severance lines 38 and 39 and their registering severance lines 44 and 45 respectively. In FIG. 8, tear strip TS2 is shown in partially torn out condition while tear strip TS3 is shown in bottle holding condition.

INDUSTRIAL APPLICABILITY

While the carrier of this invention is primarily intended for use in conjunction with large two-liter heavy bottles having neck flanges, it is obvious that the invention may also be used in conjunction with small light weight bottles in which event a larger number of bottles could be accommodated due to the unusual strength of the carrier which is made possible by the invention without impairing easy and ready removal of the bottles at the point of use.

The invention is primarily intended to utilize heavy duty paperboard of the type used in conjunction with folding boxes for example. The invention is not limited to such material and may be used in conjunction with sheet material formed of plastic or other semirigid material.

The embodiments of the invention in which an exclusive property or privilege is claimed are defined as follows:

1. A carrier for bottles having flanged neck portions, said carrier comprising an elongated tubular structure including a bottom wall (1) having a plurality of neck receiving apertures (3,4,5) therein for respectively receiving the necks of a plurality of bottles, a pair of inwardly tapered side walls foldably joined along their bottom edges to the side edges of said bottom wall, each side wall being formed of inner and outer panels (8,10,14,27) secured together in face contacting relation over at least a substantial portion of the side walls thereof, a plurality of bottle flange receiving apertures (11-13, 15-17) formed in the upper portions of said side walls and in transversely aligned relationship with said neck receiving apertures respectively, a plurality of single ply downwardly projecting pull tabs (31,32,33) struck from said neck receiving apertures respectively and disposed in coplanar relation with the inner panel of one of said side wall panels (8), a pair of weakened severance lines (34-39) formed in said inner panel of said one of said side wall panels and in general alignment with the side edges of each of said pull tabs, and a pair of weakened severance lines (40-45) formed in the outer panel of said one of said side wall panels (27) associated with said inner panel of said one of said side wall panels and in substantial alignment with each said pair of severance lines formed in said inner panel of said one of said side wall panels so that upward displacement of at least one of said pull tabs severs the material between the severance lines of the outer and inner side wall panels thereby to accommodate removal of a selected bottle.

2. A carrier according to claim 1 wherein the pairs of aligned severance lines in said outer and inner panels of said one of said side wall panels define two-ply tear strips which extend from the bottom edge of one of said side walls to the flange receiving apertures respectively in said one of said side walls.

3. A carrier according to claim 1 wherein a medial fold line (2) is formed longitudinally in said bottom wall for accommodating collapsible folding of said bottom-wall and of said side walls.

4. A carrier according to claim 1 wherein a pair of handle panels (18,22) are secured together in face contacting relation over at least a substantial portion of the areas of the handle panels thereof and respectively foldably joined along their lower edges to the upper edges of the outer panels of said side wall panels (14,27).

* * * * *